US010527979B2

(12) United States Patent
Onodera

(10) Patent No.: US 10,527,979 B2
(45) Date of Patent: Jan. 7, 2020

(54) IMAGE FORMING APPARATUS AND CONTROL PROGRAM

(71) Applicant: Konica Minolta, Inc., Tokyo (JP)

(72) Inventor: Masahiro Onodera, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/381,121

(22) Filed: Apr. 11, 2019

(65) Prior Publication Data

US 2019/0354046 A1 Nov. 21, 2019

(30) Foreign Application Priority Data

May 16, 2018 (JP) ..... 2018-094562

(51) Int. Cl.
*G03G 15/20* (2006.01)
*G03G 15/00* (2006.01)

(52) U.S. Cl.
CPC ..... *G03G 15/2021* (2013.01); *G03G 15/657* (2013.01); *G03G 15/6573* (2013.01); *G03G 2215/0129* (2013.01); *G03G 2215/2006* (2013.01)

(58) Field of Classification Search
CPC ..... G03G 15/2021; G03G 2215/2006
See application file for complete search history.

(56) References Cited

U.S. PATENT DOCUMENTS

2010/0239293 A1* 9/2010 Ishizaki ..... G03G 15/161 399/66
2010/0239295 A1* 9/2010 Mikutsu ..... G03G 15/2028 399/68

FOREIGN PATENT DOCUMENTS

JP 2013-024893 A 2/2013

* cited by examiner

*Primary Examiner* — Victor Verbitsky
(74) *Attorney, Agent, or Firm* — Lucas & Mercanti, LLP

(57) ABSTRACT

Provided is an image forming apparatus and a control program. A fixer includes a first roller which includes an elastic layer having a predetermined thickness in a surface, a second roller which includes an elastic layer having a thickness smaller than that of the first roller in a surface, a fixing belt which is laid across the first roller and forms a fixing nip portion between the second roller and the fixing belt, and first and second drive motors that drive the first and second rollers, respectively. A hardware processor controls a drive current of the first drive motor so that an electromotive current generated in the second drive motor has a predetermined value in a case where the first roller is rotatively driven by the first drive motor and the second roller is caused to rotate as a follower of the first roller and the fixing belt.

14 Claims, 7 Drawing Sheets

IMAGE FORMING APPARATUS AND CONTROL PROGRAM

CROSS-REFERENCE TO RELATED APPLICATION

The entire disclosure of Japanese Patent Application No. 2018-094562, filed on May 16, 2018, is incorporated herein by reference in its entirety.

BACKGROUND

1. Technological Field

The present invention relates to an image forming apparatus and a control program.

2. Description of the Related Art

A fixing device which can stably fix a high-quality image on a paper sheet is being demanded. In an electrophotographic image forming apparatus, a paper sheet on which a toner image is formed in an image forming unit is caused to pass through a fixing nip portion of the fixing device and is subjected to heating and pressurizing processes, so that an image is fixed on the paper sheet. In a configuration including a fixing belt, a fixing nip portion is formed between the fixing belt which is laid across a heating roller and a fixing roller, and a pressurizing roller, and in a configuration not including a fixing belt, a fixing nip portion is formed between a fixing roller and a pressurizing roller In this relation, JP 2013-24893 A discloses a fixing device which includes a fixing roller in which a thick rubber layer is formed around a relatively thin cored bar, and a pressurizing roller in which a thin rubber layer is formed around a relatively thick cored bar. Since the rubber layer of the fixing roller is formed so as to be thicker than the rubber layer of the pressurizing roller as described above, the fixing roller is softer than the pressurizing roller in a fixing nip portion, and a surface of the pressurizing roller has a convex shape while a surface of the fixing roller has a concave shape. As a result of this, there are provided advantages in that the surface of the fixing roller more easily comes into intimate contact with minute irregularities in a paper sheet, and that a paper sheet more easily separates from the fixing roller because of a convex shape of the surface of the pressurizing roller.

However, in the fixing roller in which the thick rubber layer is formed, a diameter thereof can greatly vary due to thermal expansion when it is heated. As a result of this, a speed of rotation of the pressurizing roller which comes into contact with the fixing roller under pressure may possibly be unstable.

In contrast thereto, JP 2013-24893 A discloses that even in a case where respective diameters of the fixing roller and the pressurizing roller vary in different manners due to heating, both of the rollers can be rotatively driven with stability and excellent fixing can be achieved.

SUMMARY

Nonetheless, though JP 2013-24893 A discloses that both of the fixing roller and the pressurizing roller can be rotatively driven with stability in a configuration including those rollers, the document does not disclose a technique for achieving excellent fixing in a case where only the fixing roller in which a thickness of a rubber layer is large is driven.

The present invention has been made in view of the above-described circumstances, and it is an object to provide an image forming apparatus and a control program which achieve excellent fixing in a case where only a fixing roller in which a thickness of a rubber layer is large is rotatively driven.

To achieve at least one of the above-mentioned objects, according to an aspect of the present invention, an image forming apparatus reflecting one aspect of the present invention comprises an image former, a fixer, and a hardware processor. The image former forms a toner image on a paper sheet. The fixer includes; a first roller that includes an elastic layer having a predetermined thickness in a surface; a second roller that includes an elastic layer having a thickness smaller than that of the first roller in a surface; a fixing belt that is laid across the first roller and forms a fixing nip portion between the second roller and the fixing belt by being brought into contact with the second roller under pressure; a first drive motor that drives the first roller; and a second drive motor that drives the second roller, and the fixer fixes a toner image on the paper sheet. The hardware processor controls a drive current of the first drive motor so that an electromotive current generated in the second drive motor has a predetermined value in a case where the first roller is rotatively driven by the first drive motor and the second roller is caused to rotate as a follower of the first roller and the fixing belt.

Also, a fixer of an image forming apparatus reflecting another aspect of the present invention includes: a first roller that includes an elastic layer having a predetermined thickness in a surface; a second roller that includes an elastic layer having a thickness smaller than that of the first roller in a surface, and forms a fixing nip portion between the first roller and the second roller; a first drive motor that drives the first roller; and a second drive motor that drives the second roller, and the fixer fixes a toner image on the paper sheet. The hardware processor controls a drive current of the first drive motor so that an electromotive current generated in the second drive motor has a predetermined value in a case where the first roller is rotatively driven by the first drive motor and the second roller is caused to rotate as a follower of the first roller.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
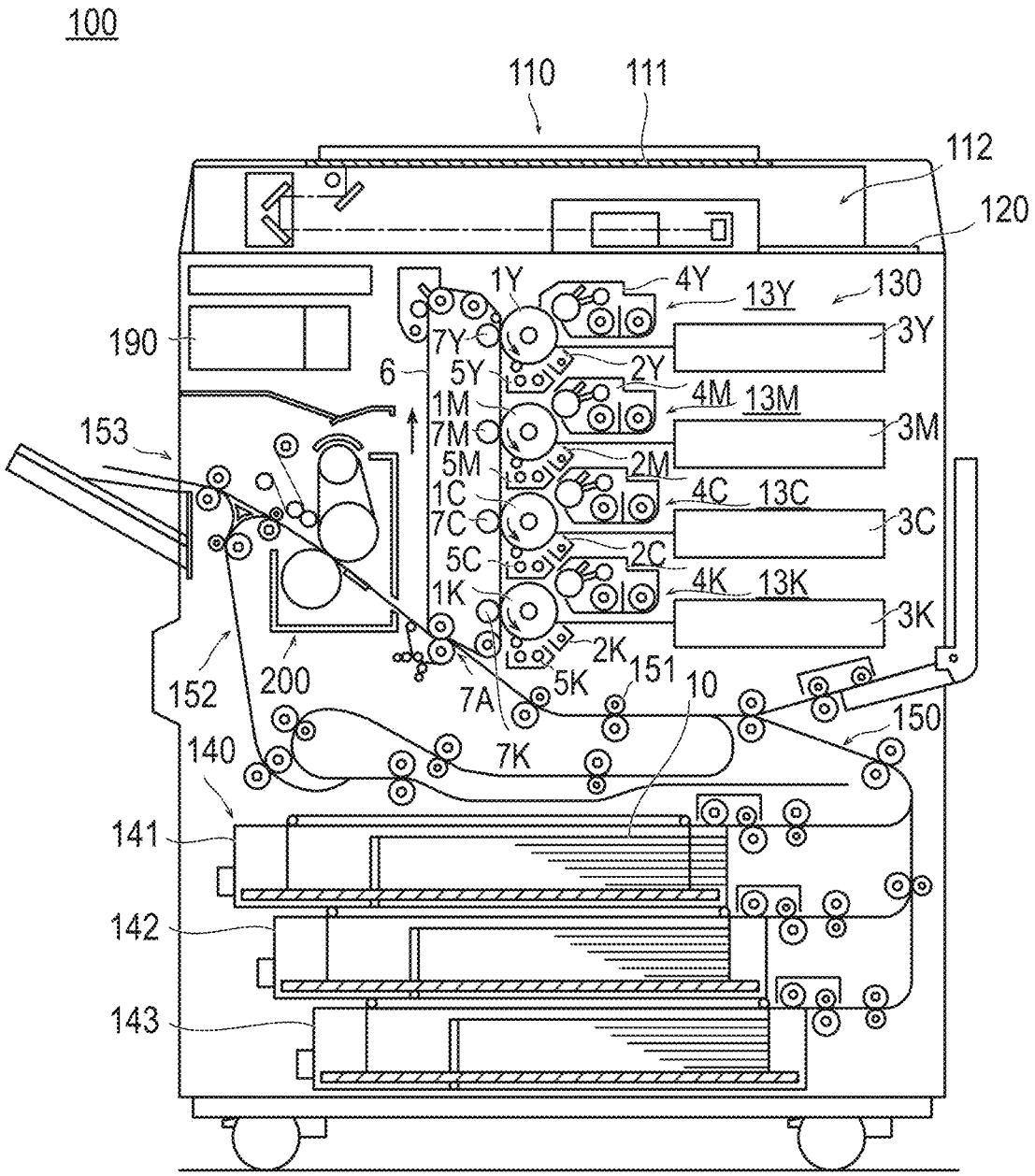
FIG. 1 is a schematic sectional view illustrating a configuration of an image forming apparatus according to one embodiment.

Hereinafter, one or more embodiments of the present invention will be described with reference to the drawings. However, the scope of the invention is not limited to the disclosed embodiments. In the description of the drawings, the same elements are denoted by the same reference numerals, and redundant description is omitted. In addition, in some cases, dimensional ratios in the drawings are exaggerated and different from actual ratios for convenience of the description.

Embodiment

<Image Forming Apparatus 100>

Figure 2:
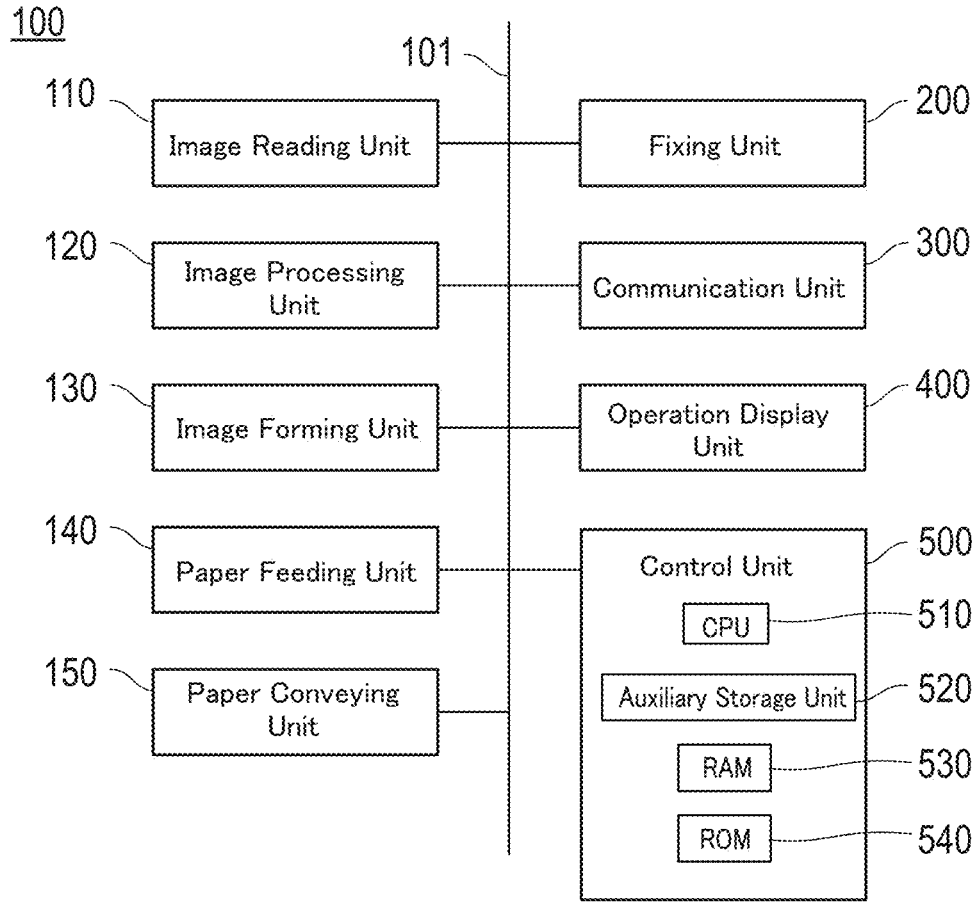
FIG. 2 is a schematic block diagram illustrating a configuration of the image forming apparatus in FIG. 1.

FIG. 1 is a schematic sectional view illustrating a configuration of an image forming apparatus 100 according to an embodiment, and FIG. 2 is a schematic block diagram illustrating a configuration of the image forming apparatus 100 in FIG. 1.

The image forming apparatus 100 is what is called a tandem color-image forming apparatus, and is configured to read out an image from an original and form (print) a read image on a paper sheet. Also, the image forming apparatus 100 receives a print job including print data and print setting information in a PDL (Page Description Language) form from an external client terminal via a network, and forms an image on a paper sheet based on the received print job. A client terminal can be a personal computer, a tablet terminal, a smartphone, or the like, for example.

As illustrated in FIG. 2, the image forming apparatus 100 includes an image reading unit 110, an image processing unit 120, an image forming unit (image former) 130, a paper feeding unit 140, a paper conveying unit 150, a fixing unit (fixer) 200, a communication unit 300, an operation display unit 400, and a control unit (hardware processor) 500. Those components are connected in such a manner that they can communicate with each other, via an internal bus 101.

The image reading unit 110 reads an original and outputs an image information signal. An image in an original which is placed on document glass 111 is subjected to scanning exposure by an optical system of a scanning exposure device of an image reading device 112, and is read into a line image sensor. An image information signal which is photoelectrically converted is subjected to analog processing, A/D conversion, shading correction, image compression, and the like in the image processing unit 120, and thereafter, is input to optical writing units 3Y, 3M, 3C, and 3K (described later) of the image forming unit 130, as print image data.

The image forming unit 130 forms an image (toner image) on a paper sheet based on print image data, with the use of a known image-forming process such as electrophotography which includes respective steps of electrification, exposure, development, and transfer. The image forming unit 130 includes four subunits of a subunit 13Y, a subunit 13M, a subunit 13C, and a subunit 13K which form images in a yellow (Y) color, a magenta (M) color, a cyan (C) color, and a black (K) color, respectively.

The subunit 13Y includes a photoconductor drum 1Y, an electrification unit 2Y placed around the photoconductor drum 1Y, the optical writing unit 3Y, a development device 4Y, and a drum cleaner 5Y.

Likewise, the subunit 13M includes a photoconductor drum 1M, an electrification unit 2M placed around the photoconductor drum 1M, the optical writing unit 3M, a development device 4M, and a drum cleaner 5M, the subunit 13C includes a photoconductor drum 1C, an electrification unit 2C placed around the photoconductor drum 1C, the optical writing unit 3C, a development device 4C, and a drum cleaner 5C, and the subunit 13K includes a photoconductor drum 1K, an electrification unit 2K placed around the photoconductor drum 1K, the optical writing unit 3K, a development device 4K, and a drum cleaner 5K.

The photoconductor drums 1Y, 1M, 1C, and 1K, the electrification units 2Y, 2M, 2C, and 2K, the optical writing units 3Y, 3M, 3C, and 3K, the development devices 4Y, 4M, 4C, and 4K, and the drum cleaners 5Y, 5M, 5C, and 5K in the subunits 13Y, 13M, 13C, and 13K are configured similarly, respectively. Hereinbelow, those components will be described without reference signs of Y, M, C, and K unless they should be distinguished from each other especially.

The image forming unit 130 writes print image data into the photoconductor drum 1 in the optical writing unit 3, and forms a latent image based on the print image data, on the photoconductor drum 1. Then, the latent image is developed by the development device 4, so that a toner image which is a visible image is formed on the photoconductor drum 1.

Images in a yellow (Y) color, a magenta (M) color, a cyan (C) color, and a black (K) color are formed on the respective photoconductor drums 1Y, 1M, 1C, and 1K of the subunits 13Y, 13M, 13C, and 13K, respectively.

An intermediate transfer belt 6 is wound across, and supported by, a plurality of rollers in such a manner that it can run. Toner images in respective colors which are formed by the subunits 13Y, 13M, 13C, and 13K are sequentially transferred onto the intermediate transfer belt 6 which is running, by primary transfer units 7Y, 7M, 7C, and 7K, so that a color image in which layers of respective colors of Y (yellow), M (magenta), C (cyan), and K (black) are superposed on each other is formed.

The paper feeding unit 140 feeds a paper sheet 10 serving as a recording material, to the image forming unit 130. The paper feeding unit 140 includes an upper-level tray 141, a middle-level tray 142, and a lower-level tray 143, and paper sheets of different sizes such as a A4 size and a A3 size, for example, are stored in the respective trays.

The paper conveying unit 150 conveys the paper sheet 10. The paper sheet 10 fed from the upper-level tray 141, the middle-level tray 142, or the lower-level tray 143 is conveyed to a secondary transfer unit 7A through a resist roller 151, and a color image on the intermediate transfer belt 6 is transferred onto the paper sheet 10.

Also, the paper conveying unit 150 includes a paper reversing unit 152 and guides the paper sheet 10 on which fixing is performed to the paper reversing unit 152, which can reverse a front surface and a back surface of the paper sheet 10 and deliver it, or can form an image on each of both surfaces of the paper sheet 10.

The fixing unit 200 fixes a formed toner image on the paper sheet 10. The paper sheet 10 on which a color image is fixed is delivered to the outside of the image forming apparatus 100 through a paper delivery unit 153. Details of the fixing unit 200 will be provided later.

The communication unit 300 is connected to a client terminal such as a personal computer, for example, via a network, and sends/receives data such as a print job.

The operation display unit 400 includes an input unit and an output unit. The input unit includes a keyboard and a touch panel, for example, and is used by a user in providing various instructions (inputs) such as inputs of text, various settings, and instructions for printing. Also, the output unit includes a display and is used to indicate a device configuration, a state of execution of a print job, occurrence of an anomaly (jam) in conveyance of a paper sheet, and the like, to a user.

The control unit 500 controls the image reading unit 110, the image processing unit 120, the image forming unit 130, the paper feeding unit 140, the paper conveying unit 150, the fixing unit 200, the communication unit 300, and the operation display unit 400. The control unit 500 includes a CPU 510, an auxiliary storage unit 520, a RAM 530, and a ROM 540.

The CPU 510 executes a control program for an image forming apparatus. The control program is stored in the auxiliary storage unit 520 and is loaded into the RAM 530 when it is executed by the CPU 510. The auxiliary storage unit 520 includes a high-capacity storage device such as a hard-disk drive or a flash memory, for example. A result of calculation or the like which is performed in association with execution by the CPU 510 is stored in the RAM 530. Various kinds of parameters, various kinds of programs, and the like are stored in the ROM 540. The CPU 510 executes the above-described control program, to fulfill various functions.

<Configuration of Fixing Unit 200>

Figure 3:
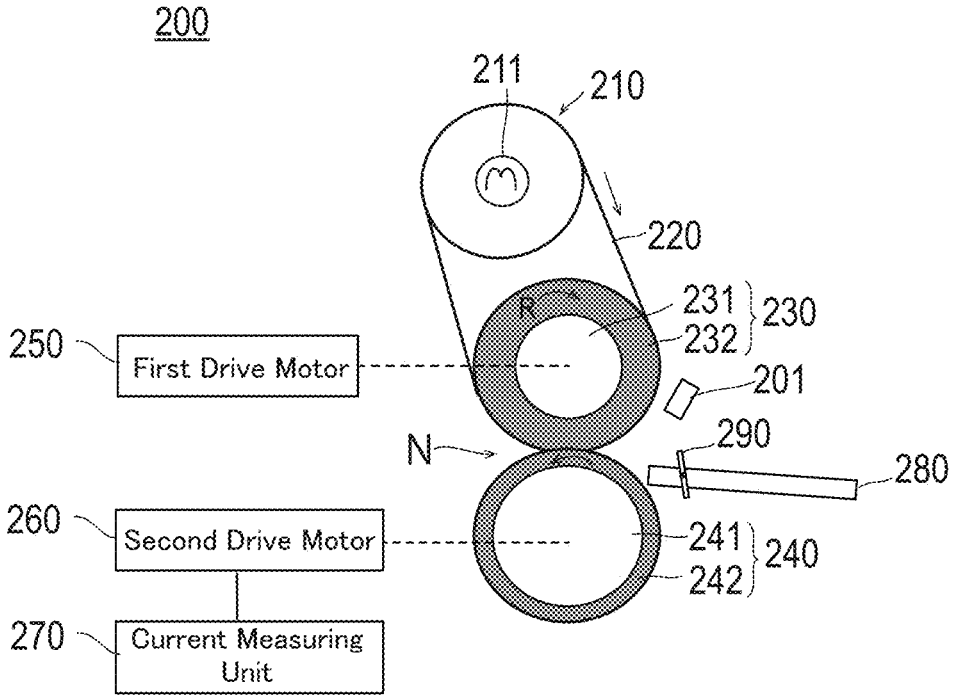
FIG. 3 is a diagrammatic view illustrating main components of a fixing unit in FIG. 1.
Figure 4:
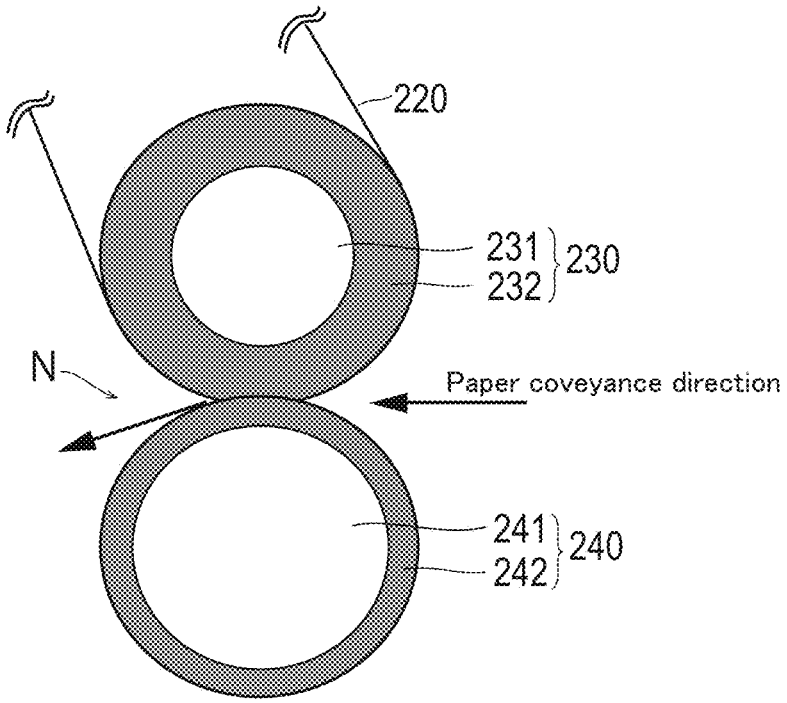
FIG. 4 is an enlarged diagrammatic view of a neighborhood of a fixing nip portion of the fixing unit in FIG. 1.

Next, a specific configuration of the fixing unit 200 will be described with reference to FIG. 3. FIG. 3 is a diagrammatic view illustrating main components of the fixing unit 200 in FIG. 1. Also, FIG. 4 is an enlarged diagrammatic view of a neighborhood of a fixing nip portion N of the fixing unit 200. It is noted that showing of a noncontact temperature sensor 201, an entry guide 280, and a loop sensor 290 in FIG. 3 is omitted in FIG. 4.

The fixing unit 200 includes the noncontact temperature sensor 201, a heating roller 210, a fixing belt 220, a fixing roller 230, a pressurizing roller 240, a first drive motor 250, a second drive motor 260, a current measuring unit 270, the entry guide 280, and the loop sensor 290.

As the heating roller 210, a tube-shaped cored bar formed of metal such as aluminum, for example, is used either directly or with an outer surface being coated with a fluorine-based resin or the like, and an outer diameter thereof is approximately 50 to 60 [mm], for example. The heating roller 210 contains a heater (a halogen heater, for example) 211 serving as a heating unit which heats the fixing belt 220.

The fixing belt 220 is formed of a base material of polyimide (PI) having a thickness of 70 [μm] in which an outer surface is covered with an elastic layer and a surface layer is further covered with a heat-resistant resin, for example. As the elastic layer, heat-resistant silicone rubber (harness: JIS-A30 [°]) having a thickness of 200 [μm], for example, can be used. Also, as the heat-resistant resin, a PFA (perfluoroalkoxy) tube having a thickness of 50 [μm], for example, can be used. The fixing belt 220 is an endless belt, and is stretched between the heating roller 210 and the fixing roller 230 under predetermined belt tension (250 [N], for example).

The fixing belt 220 comes into contact with the paper sheet 10 on which a toner image is formed, and heats the paper sheet 10 at a fixing temperature. In this regard, a fixing temperature is a temperature at which a heat quantity required to fuse toner on a paper sheet can be supplied (160 to 200 [° C.], for example), and varies with a kind or the like of the paper sheet on which an image is formed. It is noted that a surface temperature of the fixing belt 220 is detected by the noncontact temperature sensor 201, and the control unit 500 controls heating of the heater 211 so that a predetermined set temperature is maintained.

The fixing roller 230 functions as a first roller, and includes a cored bar 231 formed of tube-shaped metal, an elastic layer 232 formed of a material such as silicone rubber or foam silicone rubber which is formed on a surface of the cored bar 231, and a mold releasing layer (not shown) such as a fluorine resin, which are arranged in the stated order from an inner side. An outer diameter of the fixing roller 230 can be approximately 65 to 75 [mm], for example, a thickness of the elastic layer 232 can be approximately 15 to 25 [mm], and preferably be approximately 20 [mm], for example. A length of the fixing roller 230 along an axis is a length which adequately copes with a maximum conveyable width of a paper sheet (300 [mm], for example).

The fixing roller 230, to which power is transmitted from the first drive motor 250, is rotatively driven in R direction in FIG. 3, that is, a clockwise direction, for example. A peripheral speed of the fixing roller 230 can be set to approximately 200 [mm/s], for example. The fixing belt 220 rotates as a follower of rotation of the fixing roller 230. Accordingly, the fixing roller 230 is indirectly heated by the heater 211 via the fixing belt 220.

It is noted that in the present embodiment, in a case where the first drive motor 250 drives the fixing roller 230, the second drive motor 260 stops driving and the pressurizing roller 240 rotates as a follower of the fixing roller 230 and the fixing belt 220.

The first drive motor 250 can be a brushless motor, for example. In this case, the control unit 500 controls a magnitude and a direction of a voltage which is applied to each of U-, V-, and W-phases of the first drive motor 250, to thereby control a current flowing through a winding of each phase. For control of a current of the first drive motor 250, an inverter circuit and a PWM (Pulse Width Modulation) circuit can be used, for example.

The pressurizing roller 240 functions as a second roller, and includes a cored bar 241 formed of tube-shaped metal, an elastic layer 242 formed of a material such as silicone rubber or foam silicone rubber which is formed in a surface of the cored bar 241, and a mold releasing layer (not shown), which are arranged in the stated order from an inner side. In the present embodiment, an outer diameter of the pressurizing roller 240 is set to be identical to an outer diameter of the fixing roller 230 at a room temperature before heating by the heater 211. Also, a length of the pressurizing roller 240 along an axis and the mold releasing layer can be similar to those of the fixing roller 230. On the other hand, in the present embodiment, a thickness of the elastic layer 242 of the pressurizing roller 240 is smaller than that of the elastic layer 232 of the fixing roller 230, and the elastic layer 242 can be formed in such a manner that a thickness thereof is approximately 2 to 5 [mm], for example, and preferably, is approximately 3 [mm].

Thus, the elastic layer 232 of the fixing roller 230 is formed in such a manner that a thickness thereof is larger than a thickness of the elastic layer 242 of the pressurizing roller 240, so that the fixing roller 230 is softer than the pressurizing roller 240 in the fixing nip portion N. As illustrated in FIG. 4, when the pressurizing roller 240 is caused to come into contact with the fixing roller 230 under pressure at a predetermined fixing load with the fixing belt 220 being interposed, while a surface of the pressurizing roller 240 has a convex shape because an amount of deformation of the pressurizing roller 240 which is relatively hard is small, a surface of the fixing roller 230 has a concave shape. As a result of this, there are provided advantages in that a surface of the fixing belt 220 more easily comes into intimate contact with minute irregularities in the paper sheet 10, and that the paper sheet 10 more easily separates from the fixing belt 220 because a convex shape of a surface of the pressurizing roller 240 allows the paper sheet 10 to be delivered in accordance with a curvature of the pressurizing roller 240.

Also, the pressurizing roller 240 can be rotatively driven in a direction opposite to the above-described R direction, that is, a counterclockwise direction, by transmission of power from the second drive motor 260. It is noted that in the present embodiment, in a case where the second drive motor 260 drives the pressurizing roller 240, the first drive motor 250 stops and the fixing belt 220 and the fixing roller 230 rotate as a follower of rotation of the pressurizing roller 240. The second drive motor 260, like the first drive motor 250, can be a brushless motor, for example.

In a case where the first drive motor 250 drives the fixing roller 230, the current measuring unit 270 measures an electromotive current generated in the second drive motor 260, in accordance with an instruction of the control unit 500. An electromotive current which is proportional to a peripheral speed of rotation of the pressurizing roller 240 flows through the second drive motor 260. A measured value of an electromotive current measured by the current measuring unit 270 is transmitted to the control unit 500.

The entry guide 280 guides the paper sheet 10 which is conveyed from the image forming unit 130, to entry into the fixing nip portion N. The entry guide 280 is placed so as to extend from a conveyance path running from the image forming unit 130 to the fixing unit 200, toward the fixing nip portion N.

Also, in a case where a fixing speed is lower than a speed at which the paper sheet 10 is conveyed from the image forming unit 130 to the fixing unit 200, the paper sheet 10 warps on the entry guide 280. The loop sensor 290 which detects an amount of slack (loop) of the paper sheet 10 which is conveyed from the image forming unit 130 is placed on the entry guide 280.

The loop sensor 290 includes a bar-shaped actuator which is placed in such a manner that a tip end thereof protrudes over the entry guide 280. The actuator is configured in such a manner that an angle with respect to the entry guide 280 varies in accordance with an amount of loop of the paper sheet 10 when the paper sheet 10 being conveyed onto the entry guide 280 comes into contact with the actuator. The loop sensor 290 detects an angle of the actuator, the angle varying with an amount of loop of the paper sheet 10, and transmits the detected angle to the control unit 500. The control unit 500 calculates an amount of loop of the paper sheet 10 in accordance with an angle of the actuator. The control unit 500 and the loop sensor 290 function as an amount-of-loop detecting unit (detector). It is noted that a noncontact sensor of an optical type of the other like type may be used as a loop sensor. Also, as described later, in the present embodiment, at a time of passage of paper, the control unit 500 controls a drive current of the first drive motor 250 so that an amount of loop of the paper sheet 10 is constant, to thereby control a speed of rotation (the number of rotations) of the fixing roller 230, in a case where the first drive motor 250 rotatively drives the fixing roller 230.

<Stability of Fixing Speed>

Figure 5A:
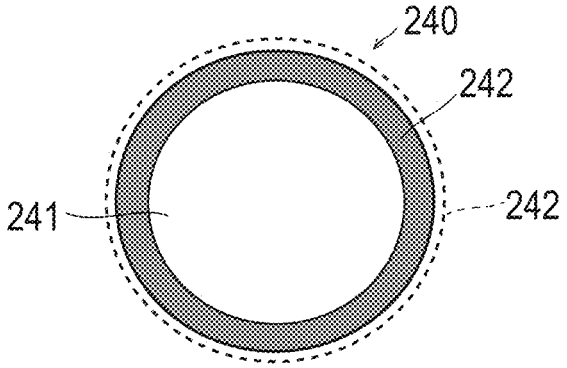
FIG. 5A is a diagrammatic view illustrating thermal expansion of a pressurizing roller by heating of a heater.
Figure 5B:
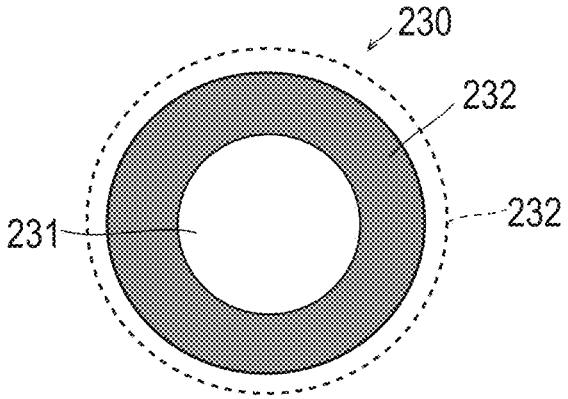
FIG. 5B is a diagrammatic view illustrating thermal expansion of a fixing roller by heating of the heater.
Figure 6:
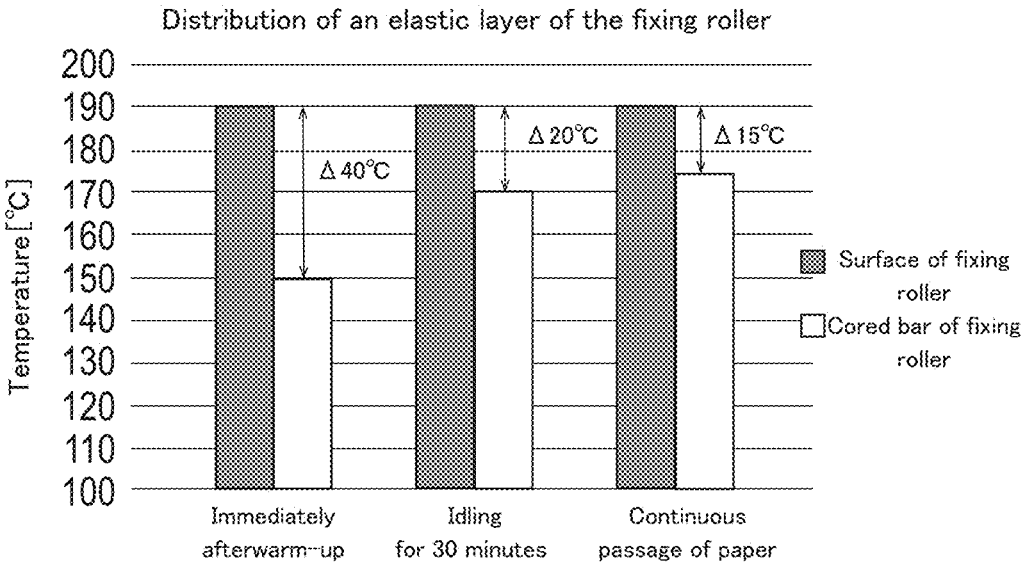
FIG. 6 is a graph illustrating temperature distribution of an elastic layer of the fixing roller in three stages from warm-up of the fixing unit in FIG. 1 to a time after continuous passage of paper.
Figure 7:
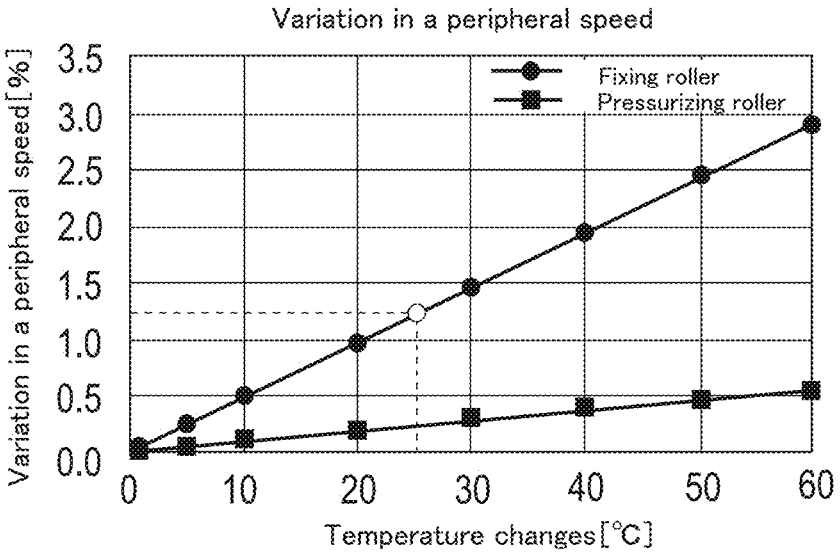
FIG. 7 is a graph illustrating variation in a peripheral speed in response to temperature changes, regarding the fixing roller and the pressurizing roller.

With reference to FIGS. 5A to 7, stability of a fixing speed in the fixing unit 200 will be described. FIGS. 5A and 5B are diagrammatic views illustrating thermal expansion of the pressurizing roller 240 and the fixing roller 230 by heating of the heater 211, respectively. In FIGS. 5A and 5B, broken lines show contours of the elastic layers 232 and 242, respectively, which are thermally expanded by heating of the heater 211. Also, FIG. 6 is a graph illustrating temperature distribution of the elastic layer 232 of the fixing roller 230 in three stages from warm-up of the fixing unit 200 to a time after continuous passage of paper. Also, FIG. 7 is a graph illustrating variation in a peripheral speed in response to temperature changes, regarding the fixing roller 230 and the pressurizing roller 240.

As a main factor of variation in a fixing speed in the fixing unit 200, in other words, a speed at which the paper sheet 10 is conveyed in the fixing nip portion N, a change in temperature of the fixing roller 230 and the pressurizing roller 240 is cited. As described above, respective outer diameters of the fixing roller 230 and the pressurizing roller 240 are set to be identical to each other at a room temperature before heating by the heater 211, and the elastic layer 232 of the fixing roller 230 is formed so as to be thicker than the elastic layer 242 of the pressurizing roller 240. On the other hand, the cored bar 231 the fixing roller 230 is formed in such a manner that an outer diameter thereof is smaller than that of a cored bar of the pressurizing roller 240. Since the elastic layers 232 and 242 are formed of a material such as silicone rubber or foam silicone rubber, coefficients of thermal expansion thereof are higher than those of the cored bars 231 and 241 which are formed of metal.

As illustrated in FIG. 5A, regarding the pressurizing roller 240, an outer diameter of the cored bar 241 is large and a thickness of the elastic layer 242 is small, so that variation in an outer diameter of the pressurizing roller 240 with a temperature is small. Accordingly, in a case where the pressurizing roller 240 is rotatively driven at a certain angular speed, a peripheral speed of the pressurizing roller 240 does not greatly vary in response to temperature changes. As a result of this, also a fixing speed does not greatly vary in response to temperature changes.

On the other hand, as illustrated in FIG. 5B, regarding the fixing roller 230, an outer diameter of the cored bar 231 is small and a thickness of the elastic layer 232 is large, so that variation in an outer diameter of the fixing roller 230 with a temperature is large. Accordingly, in a case where the fixing roller 230 is rotatively driven at a certain angular speed, a peripheral speed of the fixing roller 230 can greatly vary in response to temperature changes. As a result of this, also a fixing speed can greatly vary in response to temperature changes.

A temperature of the elastic layer 232 of the fixing roller 230 can vary with respective stages of fixing operations after the fixing unit 200 starts operating. Also, there can be caused a difference in temperature between portions in the elastic layer 232.

As illustrated in FIG. 6, immediately after warm-up, the elastic layer 232 is not sufficiently heated in some cases, and there is a temperature difference of 40 [° C.] between a surface and a portion close to a cored bar in the elastic layer 232. In this case, expansion of the elastic layer 232 is small, and an outer diameter of the fixing roller 230 does not greatly vary from that before heating.

Thereafter, by idling for thirty minutes, heat diffuses from the outside to the inside of the elastic layer 232, so that a temperature difference between a surface and a portion close to a cored bar in the elastic layer 232 becomes equal to 20 [° C.]. Then, after continuous passage of paper, the elastic layer 232 including a portion close to the cored bar 231 is sufficiently heated, so that a temperature difference between a surface and a portion close to a cored bar in the elastic layer 232 is reduced to 15 [° C.]. In this case, the elastic layer 232 expands, and an outer diameter of the fixing roller 230 becomes larger than that before heating.

Additionally, even in a state where a whole of the elastic layer 232 is sufficiently heated, when a print job is started and the fixing roller 230 and the pressurizing roller 240 start rotating, heat of the fixing roller 230 is removed by the pressurizing roller 240, so that a temperature of the fixing roller 230 can suddenly fall. This may make an outer diameter of the fixing roller 230 small in some cases.

Thus, in the fixing roller 230, there is a difference of approximately 25 [° C.] in temperature of a portion close to the cored bar 231 of the elastic layer 232 between a time immediately after warm-up and a time after continuous passage of paper.

As illustrated in FIG. 7, regarding the fixing roller 230 and the pressurizing roller 240, variation in a peripheral speed in response to temperature changes is obtained by calculation. For example, in a case where the elastic layers 232 and 242 are formed of silicone rubber, a coefficient of linear expansion thereof is 2.5 to $4\times10^{-4}$ [/° C.], and a coefficient of volumetric expansion is three times a coefficient of linear expansion, that is, 0.075 to 0.12 [%/° C.]. In an example in FIG. 7, a coefficient of volumetric expansion is set to 0.12 [%/° C.], an outer diameter of the fixing roller 230 and a thickness of the elastic layer 232 are set to 70 and 20 [mm], respectively, and an outer diameter of the pressurizing roller 240 and a thickness of the elastic layer 242 are set to 70 and 3 [mm], respectively. In an example in FIG. 6, a change in temperature of approximately 25° C. is caused in the elastic layer 232 for a duration from a time immediately after warm-up to a time after continuous passage of paper, and this change in temperature corresponds to variation of 1.25 [%] in peripheral speed as illustrated in FIG. 7.

Thus, with regard to a case where the fixing roller 230 or the pressurizing roller 240 is rotatively driven at a certain angular speed, a fixing speed in a case where the pressurizing roller 240 is driven is more stable than that in a case where the fixing roller 230 is driven. Accordingly, in a normal mode, the control unit 500 exercises control so that it drives the pressurizing roller 240 and causes the fixing roller 230 and the fixing belt 220 to rotate as a follower of rotation of the pressurizing roller 240.

In the meantime, in the present embodiment, the image forming apparatus 100 has a glossiness adjustment mode in addition to a normal mode. In a glossiness adjustment mode, the control unit 500 rotatively drives the fixing roller 230. In a case where the fixing roller 230 is rotatively driven, a slight difference in speed in the fixing nip portion N of the fixing belt 220 and the pressurizing roller 240 is changed from that in a case where the pressurizing roller 240 is driven in a normal mode, so that glossiness of a printed image is changed. In a case where the fixing roller 230 is rotatively driven and the pressurizing roller 240 is caused to rotate as a follower, the image forming apparatus 100 exercises the following control in an effort to stabilize a fixing speed.

<Control Method for Image Forming Apparatus 100>

Figure 8:
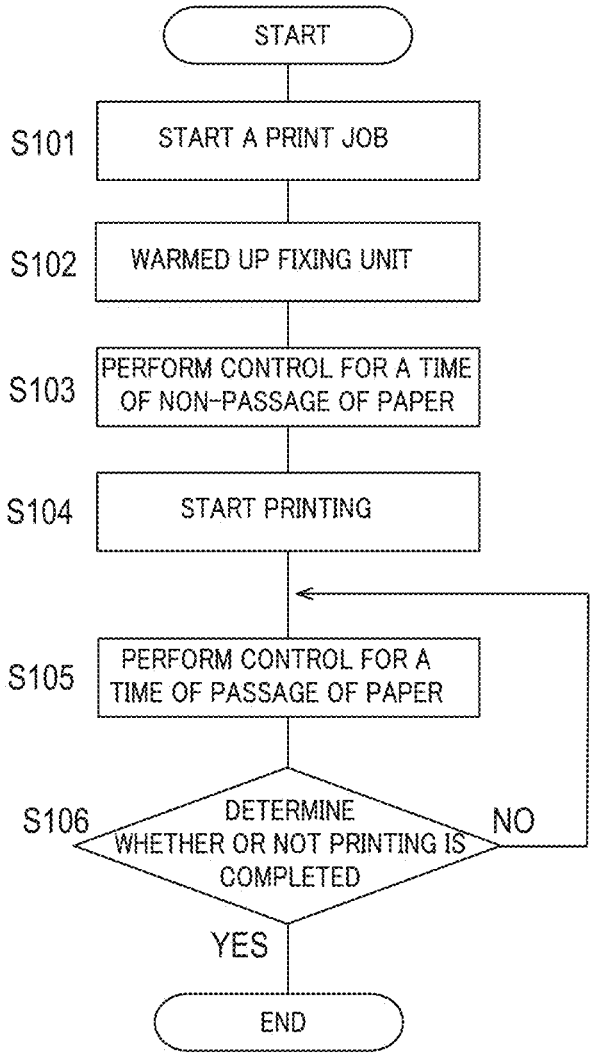
FIG. 8 is a flow chart illustrating a procedure of a control method for the image forming apparatus according to the one embodiment.
Figure 9:
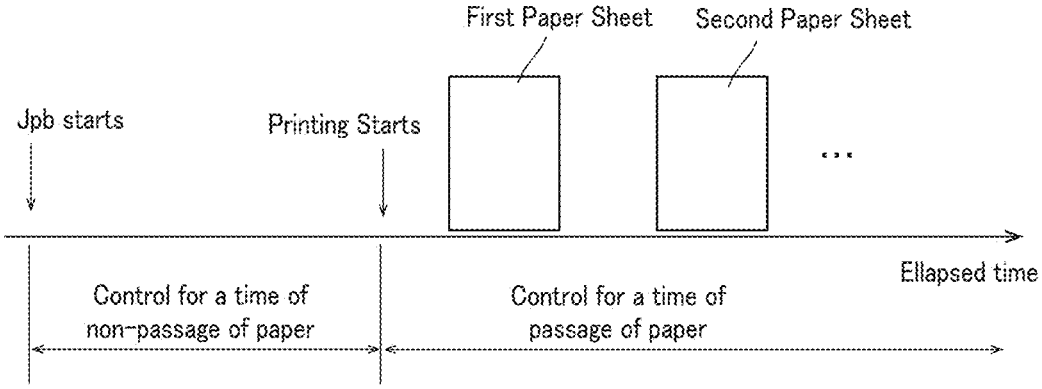
FIG. 9 is a diagrammatic view for chronologically explaining operations of the image forming apparatus.
Figure 10A:
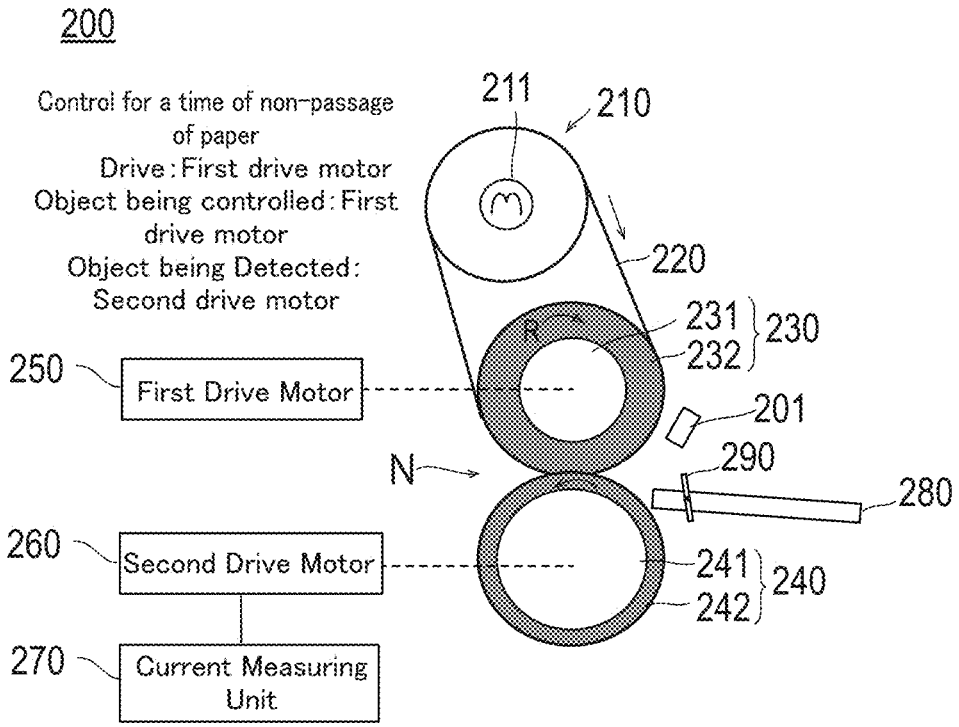
FIG. 10A is a diagrammatic view illustrating control for a time of non-passage of paper in the fixing unit in FIG. 1.
Figure 10B:
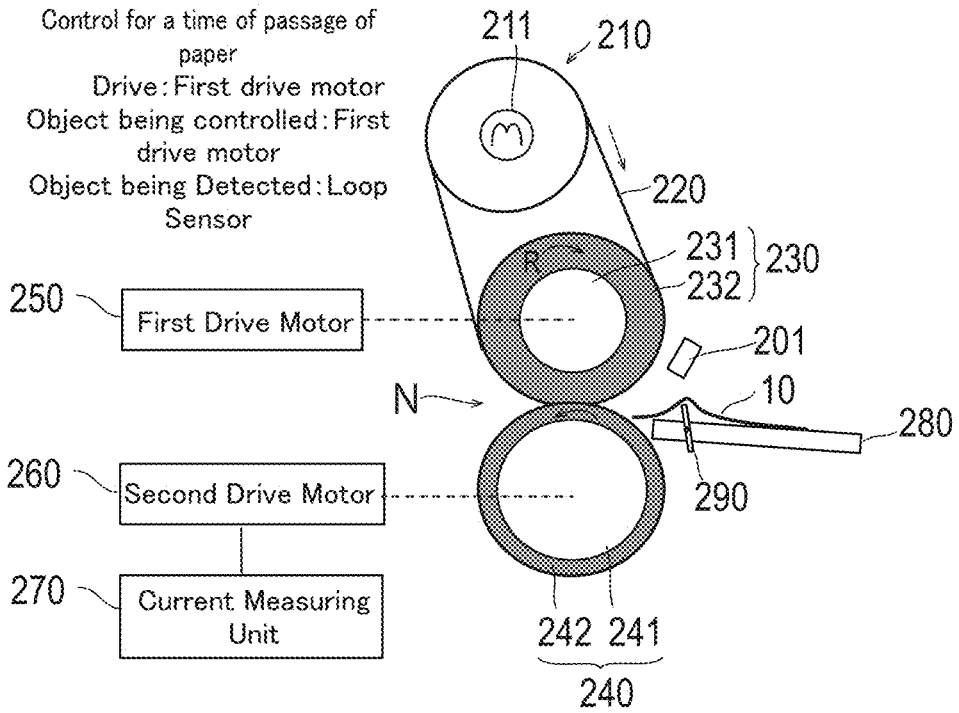
FIG. 10B is a diagrammatic view illustrating control for a time of passage of paper in the fixing unit in FIG. 1.

FIG. 8 is a flow chart illustrating a procedure of a control method for the image forming apparatus 100 according to the present embodiment, and FIG. 9 is a schematic view for chronologically explaining operations of the image forming apparatus 100. Also, FIG. 10A is a schematic view illustrating control for a time of non-passage of paper in the fixing unit 200, and FIG. 10B is a schematic view illustrating control for a time of passage of paper in the fixing unit 200.

First, a print job is started (step S101). For example, in a case where a user gives an instruction for execution of printing from a client terminal, a print job is sent to the image forming apparatus 100 from a client terminal. The image forming apparatus 100 receives a print job, and the control unit 500 controls respective units in accordance with print setting information of a print job.

Subsequently, the fixing unit 200 is warmed up (step S102). The control unit 500 heats the heater 211 and exercises control so that a temperature of the fixing nip portion N increases to a fixing temperature.

Subsequently, control for a time of non-passage of paper is exercised (step S103). As illustrated in FIG. 9, in a glossiness adjustment mode, the control unit 500 exercises the following control for a time of non-passage of paper in the fixing unit 200 before printing on the first paper sheet is started (at a time of non-passage of paper).

In a case where the fixing roller 230 is rotatively driven by the first drive motor 250 and the pressurizing roller 240 is caused to rotate as a follower of the fixing roller 230 and the fixing belt 220, the control unit 500 controls a drive current of the first drive motor 250 so that an electromotive current generated in the second drive motor 260 has a predetermined value.

More specifically, as shown in FIG. 10A, the first drive motor 250 is driven in order to rotatively drive the fixing roller 230, and this causes the pressurizing roller 240 to rotate as a follower of rotation of the fixing belt 220. Then, because of rotation of the pressurizing roller 240, an electromotive current generated in the second drive motor 260 is detected by the current measuring unit 270. While an outer diameter of the fixing roller 230 can greatly vary in response to temperature changes as described above, variation in an outer diameter of the pressurizing roller 240 in response to temperature changes is small. Accordingly, to control a drive current of the first drive motor 250 so that an electromotive current generated in the second drive motor 260 is kept equal to a predetermined value, allows the pressurizing roller 240 to rotate at a predetermined peripheral speed. Thus, in control for a time of non-passage of paper, the first drive motor is set as an object being driven and being controlled and the second drive motor is set as an object being detected, so that an outer diameter of the fixing roller 230 is prevented from varying under influence of temperature changes in the elastic layer 232, so that stabilization of a fixing speed is achieved.

Subsequently, printing is started (step S104). The control unit 500 sequentially feeds the preset kinds and the preset numbers of paper sheets to the image forming apparatus from the paper feeding unit 140 based on print setting information of a print job. The image forming unit 130 forms an image on the paper sheet 10 based on print data of a print job. The paper sheet 10 on which an image is formed is conveyed to the fixing unit 200.

Also, the control unit 500 exercises control for a time of passage of paper (step S105). As illustrated in FIG. 9, in a glossiness adjustment mode, the control unit 500 exercises the following control for a time of passage of paper in the fixing unit 200 when printing is started (at a time of passage of paper).

In a case where the fixing roller 230 is rotatively driven by the first drive motor 250 and the pressurizing roller 240 is caused to rotate as a follower of the fixing roller 230 and the fixing belt 220, the control unit 500 controls a drive current of the first drive motor 250 so that an amount of loop of the paper sheet 10 is constant.

More specifically, as shown in FIG. 10B, the first drive motor 250 is driven in order to rotatively drive the fixing roller 230, and the paper sheet 10 is conveyed from the image forming unit 130 toward the fixing nip portion N at a predetermined conveyance speed which is a reference speed. An amount of loop of the paper sheet 10 is detected by the loop sensor 290 on the entry guide 280. While an amount of loop of the paper sheet 10 is reduced if a fixing speed is higher than a predetermined conveyance speed, an amount of loop of the paper sheet 10 is increased if a fixing speed is lower than a predetermined conveyance speed. Accordingly, to control a drive current of the first drive motor 250 so that an amount of loop of the paper sheet is kept constant, allows a speed at which the paper sheet 10 is conveyed from the image forming unit 130 to the fixing nip portion N and a fixing speed to be identical to each other. Thus, in control for a time of passage of paper, the first drive motor 250 is set as an object being driven and being controlled and the loop sensor 290 is set as an object being detected, so that an outer diameter of the fixing roller 230 is prevented from varying under influence of temperature changes, so that a fixing speed can be made identical to a speed at which the paper sheet 10 is conveyed from the image forming unit 130 to the fixing nip portion N.

Next, it is determined whether or not printing is completed (step S106). The control unit 500 determines whether or not printing on sheets and copies in numbers which are set in print setting information of a print job is completed. If printing is completed (YES in step S106), the control unit 500 finishes processes (END). On the other hand, printing is not completed (NO in step S106), the control unit 500 shifts to a process of a step S105.

In the above-described processes in the flow chart of FIG. 8, in control for a time of non-passage of paper, in a case where the fixing roller 230 is rotatively driven and the pressurizing roller 240 is caused to rotate as a follower, a drive current of the first drive motor 250 is controlled so that an electromotive current generated in the second drive motor 260 has a predetermined value. Also, in control for a time of passage of paper, in a case where the fixing roller 230 is rotatively driven and the pressurizing roller 240 is caused to rotate as a follower, a drive current of the first drive motor 250 is controlled so that an amount of loop of the paper sheet 10 which enters into the fixing nip portion N is constant.

Additionally, in a case where a postprocessing apparatus is connected in a subsequent stage of the image forming apparatus 100, after printing is started, a wide space may be left between paper sheets due to a need to wait for postprocessing or for the other like reasons in some cases. If passage of paper is not observed for a predetermined period of time, the control unit 500 may exercise control for a time of non-passage of paper until passage of paper is restarted.

(Modification)

The above description has dealt with a case where the fixing unit 200 includes the fixing nip portion N between the fixing belt 220 which is laid across the heating roller 210 and the fixing roller 230, and the pressurizing roller 240. The present modification will describe a case where a fixing unit 600 does not include a fixing belt, and includes the fixing nip portion N between a fixing roller 610 and a pressurizing roller 620.

Figure 11A:
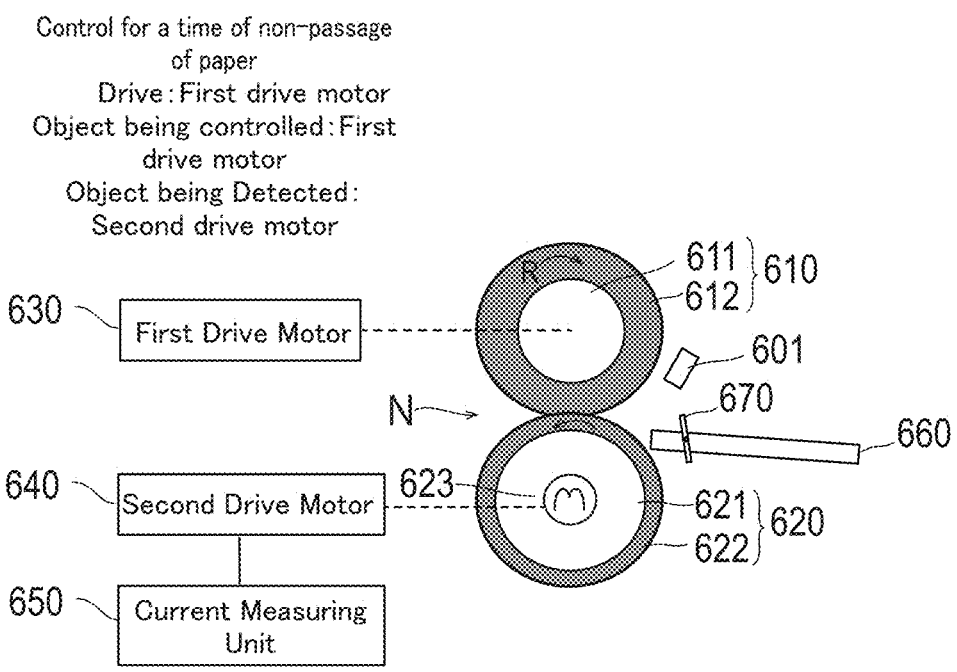
FIG. 11A is a diagrammatic view illustrating control for a time of non-passage of paper in a fixing unit which does not include a fixing belt.
Figure 11B:
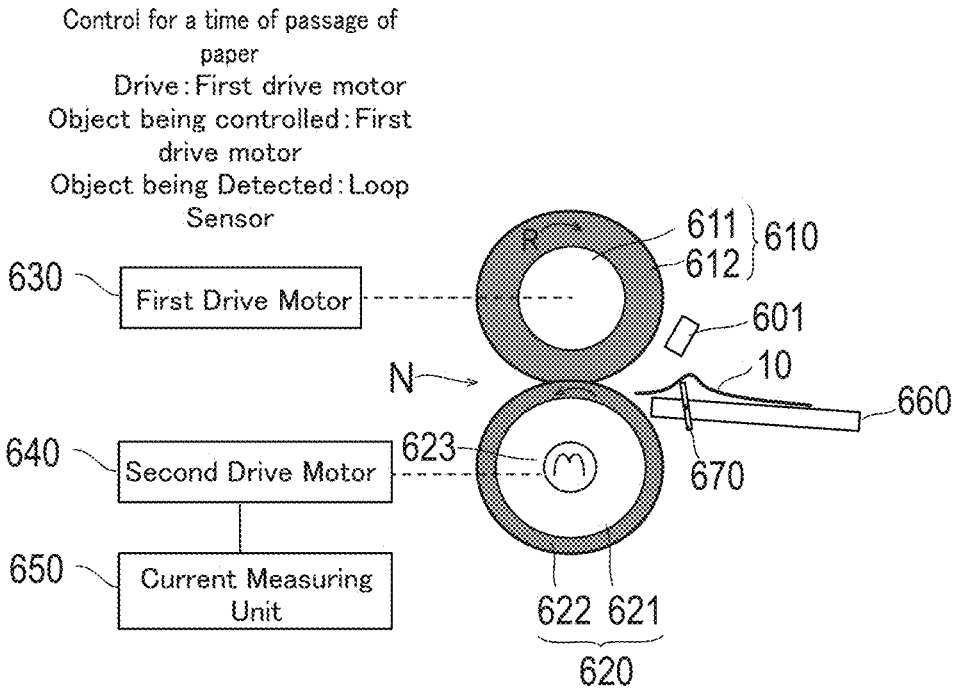
FIG. 11B is a diagrammatic view illustrating control for a time of passage of paper in a fixing unit which does not include a fixing belt.

FIG. 11A is a schematic view illustrating control for a time of non-passage of paper in the fixing unit 600 which does not include a fixing belt, and FIG. 11B is a schematic view illustrating control for a time of passage of paper in the fixing unit 600 which does not include a fixing belt.

As illustrated in FIG. 11A, the fixing unit 600 includes a noncontact temperature sensor 601, the fixing roller 610, the pressurizing roller 620, a first drive motor 630, a second drive motor 640, a current measuring unit 650, an entry guide 660, and a loop sensor 670.

The fixing roller 610 includes a cored bar 611 and an elastic layer 612. The cored bar 611 and the elastic layer 612 are configured similarly to the cored bar 231 and the elastic layer 232, respectively, and so detailed description thereof is omitted.

Also, the pressurizing roller 620 includes a cored bar 621, an elastic layer 622, and a heater 623. The cored bar 621, the elastic layer 622, and the heater 623 are configured similarly to the cored bar 241, the elastic layer 242, and the heater 211, respectively, and so detailed description thereof is omitted.

Also, the first drive motor 630, the second drive motor 640, the current measuring unit 650, the entry guide 660, and the loop sensor 670 are configured similarly to the first drive motor 250, the second drive motor 260, the current measuring unit 270, the entry guide 280, and the loop sensor 290, respectively, and so detailed description thereof is omitted.

At a time of non-passage of paper, in a case where the fixing roller 610 is rotatively driven by the first drive motor 630 and the pressurizing roller 620 is caused to rotate as a follower of the fixing roller 610, the control unit 500 controls a drive current of the first drive motor 630 so that an electromotive current generated in the second drive motor 640 has a predetermined value.

Also, as illustrated in FIG. 11B, at a time of passage of paper, in a case where the fixing roller 610 is rotatively driven by the first drive motor 630 and the pressurizing roller 620 is caused to rotate as a follower of the fixing roller 610, the control unit 500 controls a drive current of the first drive motor 630 so that an amount of loop of the paper sheet 10 is constant.

The image forming apparatus 100 according to the present embodiments which have been described above produces the following effects.

In the fixing units 200 and 600 each including a fixing roller and a pressurizing roller which include respective elastic layers which are different from each other in thickness, in surfaces thereof, even in a case where only a fixing roller in which a thickness of an elastic layer is large is driven, a fixing speed is stable. Accordingly, even in a case where only a fixing roller is rotatively driven, excellent fixing can be achieved.

Particularly, after a print job is started, for the first paper sheet which is provided immediately after warm-up or a paper sheet which is widely spaced from a preceding paper, a fixing speed is stable, so that a defective image is prevented from occurring due to discrepancy between a speed at which a paper sheet is conveyed to the fixing nip portion N and a fixing speed.

Hereinabove, in the present embodiments, the image forming apparatus 100 and the control program have been described. However, it goes without saying that a skilled person can appropriately make addition, modification, and omission to the present invention within a scope of its technical ideas.

For example, in the above embodiments, a case where a thickness of an elastic layer of a fixing roller is larger than that of an elastic layer of a pressurizing roller and the fixing roller is rotatively driven has been described. However, the present invention is not limited to that case, and there may be provided a configuration in which a thickness of an elastic layer of a pressurizing roller is larger than that of an elastic layer of a fixing roller and the pressurizing roller is rotatively driven.

Also, the control program for the image forming apparatus 100 may be offered by a computer-readable recording medium such as a USB memory, a flexible disk, or a CD-ROM, or may be offered on-line via a network such as Internet. In this case, a program recorded on a computer-readable medium is transmitted to, and stored in, a memory or a storage, generally. Also, the control program may be offered as independent application software, or may be incorporated into software of each device as one of functions of the image forming apparatus 100.

Although embodiments of the present invention have been described and illustrated in detail, the disclosed embodiments are made for purposes of illustration and example only and not limitation. The scope of the present invention should be interpreted by terms of the appended claims.

What is claim is:

1. An image forming apparatus comprising:

an image former that forms a toner image on a paper sheet;

a fixer that includes a first roller that includes an elastic layer having a predetermined thickness in a surface, a second roller that includes an elastic layer having a thickness smaller than that of the first roller in a surface, a fixing belt that is laid across the first roller and forms a fixing nip portion between the second roller and the fixing belt by being brought into contact with the second roller under pressure, a first drive motor that drives the first roller, and a second drive motor that drives the second roller, the fixer fixing a toner image on the paper sheet; and a hardware processor that:

controls a drive current of the first drive motor so that an electromotive current generated in the second drive motor has a predetermined value in a case where the first roller is rotatively driven by the first drive motor and the second roller is caused to rotate as a follower of the first roller and the fixing belt.

2. An image forming apparatus comprising:

an image former that forms a toner image on a paper sheet;

a fixer that includes a first roller that includes an elastic layer having a predetermined thickness in a surface, a second roller that includes an elastic layer having a thickness smaller than that of the first roller in a surface and forms a fixing nip portion between the first roller and the second roller, a first drive motor that drives the first roller, and a second drive motor that drives the second roller, the fixer fixing a toner image on the paper sheet; and a hardware processor that:

controls a drive current of the first drive motor so that an electromotive current generated in the second drive motor has a predetermined value in a case where the first roller is rotatively driven by the first drive motor and the second roller is caused to rotate as a follower of the first roller.

3. The image forming apparatus of claim 1, wherein the hardware processor controls a drive current of the first drive motor so that an electromotive current generated in the second drive motor has a predetermined value at a time of non-passage of paper.

4. The image forming apparatus of claim 2, wherein the hardware processor controls a drive current of the first drive motor so that an electromotive current generated in the second drive motor has a predetermined value at a time of non-passage of paper.

5. The image forming apparatus of claim 1, wherein the first roller is a fixing roller that comes into contact with the toner image on a paper sheet that is conveyed to the fixing nip portion.

6. The image forming apparatus of claim 2, wherein the first roller is a fixing roller that comes into contact with the toner image on a paper sheet that is conveyed to the fixing nip portion.

7. The image forming apparatus of claim 3, further comprising:

an entry guide that guides the paper sheet to the fixing nip portion; and an amount-of-loop detector that detects an amount of loop of the paper sheet that is guided by the entry guide and enters into the fixing nip portion, wherein at a time of passage of paper, the hardware processor controls a drive current of the first drive motor so that an amount of loop of the paper sheet is constant, to control a speed of rotation of the first roller, in a case where the first roller is rotatively driven by the first drive motor and the second roller is caused to rotate as a follower of the first roller.

8. The image forming apparatus of claim 4, further comprising:

an entry guide that guides the paper sheet to the fixing nip portion; and an amount-of-loop detector that detects an amount of loop of the paper sheet that is guided by the entry guide and enters into the fixing nip portion, wherein at a time of passage of paper, the hardware processor controls a drive current of the first drive motor so that an amount of loop of the paper sheet is constant, to control a speed of rotation of the first roller, in a case where the first roller is rotatively driven by the first drive motor and the second roller is caused to rotate as a follower of the first roller.

9. A non-transitory computer readable storage medium storing a control program for an image forming apparatus including: an image former that forms a toner image on a paper sheet; and a fixer that includes a first roller that includes an elastic layer having a predetermined thickness in a surface, a second roller that includes an elastic layer having a thickness smaller than that of the first roller in a surface, a fixing belt that is laid across the first roller and forms a fixing nip portion between the second roller and the fixing belt by being brought into contact with the second roller under pressure, a first drive motor that drives the first roller, and a second drive motor that drives the second roller, the fixer fixing a toner image on the paper sheet, the control program causing the image forming apparatus to perform:

(a) controlling a drive current of the first drive motor so that an electromotive current generated in the second drive motor has a predetermined value in a case where the first roller is rotatively driven by the first drive motor and the second roller is caused to rotate as a follower of the first roller and the fixing belt.

10. A non-transitory computer readable storage medium storing a control program for an image forming apparatus including: an image former that forms a toner image on a paper sheet; and a fixer that includes a first roller that includes an elastic layer having a predetermined thickness in a surface, a second roller that includes an elastic layer having a thickness smaller than that of the first roller in a surface and forms a fixing nip portion between the first roller and the second roller, a first drive motor that drives the first roller, and a second drive motor that drives the second roller, the fixer fixing a toner image on the paper sheet, the control program causing the image forming apparatus to perform:

(a) controlling a drive current of the first drive motor so that an electromotive current generated in the second drive motor has a predetermined value in a case where the first roller is rotatively driven by the first drive motor and the second roller is caused to rotate as a follower of the first roller.

11. The non-transitory computer-readable storage medium of claim 9, wherein in the procedure (a), at a time of non-passage of paper, a drive current of the first drive motor is controlled so that an electromotive current generated in the second drive motor has a predetermined value.

12. The non-transitory computer-readable storage medium of claim 10, wherein in the procedure (a), at a time of non-passage of paper, a drive current of the first drive motor is controlled so that an electromotive current generated in the second drive motor has a predetermined value.

13. The non-transitory computer-readable storage medium of claim 11, wherein the image forming apparatus further includes:

an entry guide that guides the paper sheet to the fixing nip portion; and an amount-of-loop detector that detects an amount of loop of the paper sheet that is guided by the entry guide and enters into the fixing nip portion, the control program further includes a procedure (b) after the procedure (a), and in the procedure (b), at a time of passage of paper, a drive current of the first drive motor is controlled so that an amount of loop of the paper sheet is constant, to control a speed of rotation of the first roller, in a case where the first roller is rotatively driven by the first drive motor and the second roller is caused to rotate as a follower of the first roller.

14. The non-transitory computer-readable storage medium of claim 12, wherein the image forming apparatus further includes:

an entry guide that guides the paper sheet to the fixing nip portion; and an amount-of-loop detector that detects an amount of loop of the paper sheet that is guided by the entry guide and enters into the fixing nip portion, the control program further includes a procedure (b) after the procedure (a), and in the procedure (b), at a time of passage of paper, a drive current of the first drive motor is controlled so that an amount of loop of the paper sheet is constant, to control a speed of rotation of the first roller, in a case where the first roller is rotatively driven by the first drive motor and the second roller is caused to rotate as a follower of the first roller.

* * * * *